United States Patent [19]

Allen

[11] Patent Number: 4,478,016

[45] Date of Patent: Oct. 23, 1984

[54] DOOR JAMB LEVELER

[76] Inventor: Ernest R. Allen, 1131 Vine St., Jonesboro, Ark. 72401

[21] Appl. No.: 418,429

[22] Filed: Sep. 15, 1982

[51] Int. Cl.[3] ..... E04D 14/00

[52] U.S. Cl. ..... 52/126.1; 52/213; 52/741; 33/194

[58] Field of Search ..... 52/213, 214, 217, 204, 52/211, 212, 741, 126.1; 33/370, 375, 382, 194, 376

[56] References Cited

U.S. PATENT DOCUMENTS

| | | | |
|---|---|---|---|
| 441,522 | 11/1890 | Watson | 33/194 |
| 1,003,517 | 9/1911 | Scelza | 33/194 |
| 1,074,367 | 9/1913 | Keefauver | 33/376 |
| 2,245,351 | 6/1941 | Mettleman | 52/213 |
| 2,284,012 | 5/1942 | Paca | 52/213 |
| 2,689,412 | 9/1954 | Young | 33/375 X |
| 2,748,493 | 6/1956 | Williams | 33/194 |
| 3,325,627 | 4/1968 | Bursiek et al. | 52/213 X |
| 3,636,672 | 1/1972 | Fink | 52/213 X |

*Primary Examiner*—Carl D. Friedman

*Attorney, Agent, or Firm*—LeBlanc, Nolan, Shur & Nies

[57] ABSTRACT

A device for use in positioning and securing a door jamb in a level condition. The device includes a spacer plate assembly having a planar member with a lip extension at each end which extends beneath the inner portion of the sides of the jamb during the leveling process. A pair of bolt shaped members are threadedly received in the planar member, one at each end thereof, to provide a means of raising and lowering the ends of the spacer plate assembly. A suitable level indicating unit such as a carpenter's level is also mounted on the spacer plate. The device further includes a pair of anchor base plates which are mounted in the floor, one at each end of the spacer plate, adjacent the lip extensions. The bolt members are rotated until the level indicating unit shows the spacer plate to be in a level condition, at which time each side of the door jamb is fixed to the respective anchor base plate by anchor screws or similar means. The spacer assembly is then withdrawn, leaving the door jamb mounted in a level condition on the anchor base plates.

4 Claims, 4 Drawing Figures

10
11
12
14
16
17
18
20
24
26
28
29
30
31
32
33
34
35
36
38
40
42

DOOR JAMB LEVELER

BACKGROUND AND SUMMARY OF THE INVENTION

The present invention relates to a device for leveling door jambs. More particularly, the present invention is concerned with a device which allows the leveling of prefabricated metal door jambs without the use of wedges so that the door jambs may be very rapidly erected and secured to the floor during construction of a building in which doors or similar frames are to be installed.

Previous devices for aligning door jambs have included those described in the following U.S. Pat. No.: 2,689,412 to Young; U.S. Pat. No. 2,748,493 to Williams; and U.S. Pat. No. 2,855,695 to Buck. In the Buck patent there is described a vertical frame which is utilized within the door jamb to hold the jamb in alignment while wedges are used. In the Williams patent there is described the use of horizontal leveling means for a device which is intended to provide a frame within the door jamb. The Young patent discloses the use of hand screws to raise and lower a leveling device but there is no disclosure of the use of any type of jamb anchor feature for maintaining the door jamb in position.

By the present invention there is provided a device for use in leveling door jambs in a rapid and efficient manner without the use of wedges, shims or other aids of this type. The door jamb leveling device of the present invention includes a spacer plate assembly which, during use, is intended to extend along the floor between the inner surfaces of the sides of an upright door jamb. The spacer plate is provided on each end thereof with a lip extension of relatively thin construction which extends beneath the inner portion of each side of the jamb. A pair of leveler swivels are threadedly received in the spacer plate, one at each end thereof, to be controlled by hand screws for the purpose of raising and lowering the entire assembly. The upper surface of the spacer plate assembly is so constructed as to support a standard carpenter's level. The present leveling device also includes a pair of jamb anchors in the form of base plate members which are disposed with one anchor positioned within each of the side portions of the door jamb in position flush with the floor, said anchor plates having upstanding portions which conform to the interior configuration of the hollow side portions of the door jamb.

In order to level the door jamb, the spacer plate assembly is positioned on the floor so as to extend across the width of the proposed doorway. The jamb anchor plates are anchored to the floor adjacent each end of the spacer assembly and the door jamb is positioned so as to rest on the lip extensions of the spacer plate. The hand screws on the spacer plate assembly are turned, thus raising or lowering the spacer plate, until the sight glass in the carpenter's level shows the jamb to be in a level condition. Suitable securing means such as screws are then employed to secure the door jamb to the jamb anchor plates thus retaining the door jamb at the desired height. The spacer plate assembly may then be removed from the doorway and the jamb will remain mounted in a level condition on the anchor plates.

The door jamb leveling device of the present invention is particularly suitable for use with metal prefabricated door jambs and allows the leveling of such door jambs in a matter of minutes as compared with an hour or more which has been required to level door jambs by the use of previous methods using shims, wedges and the like.

DESCRIPTION OF THE PREFERRED EMBODIMENTS

Figure 1:
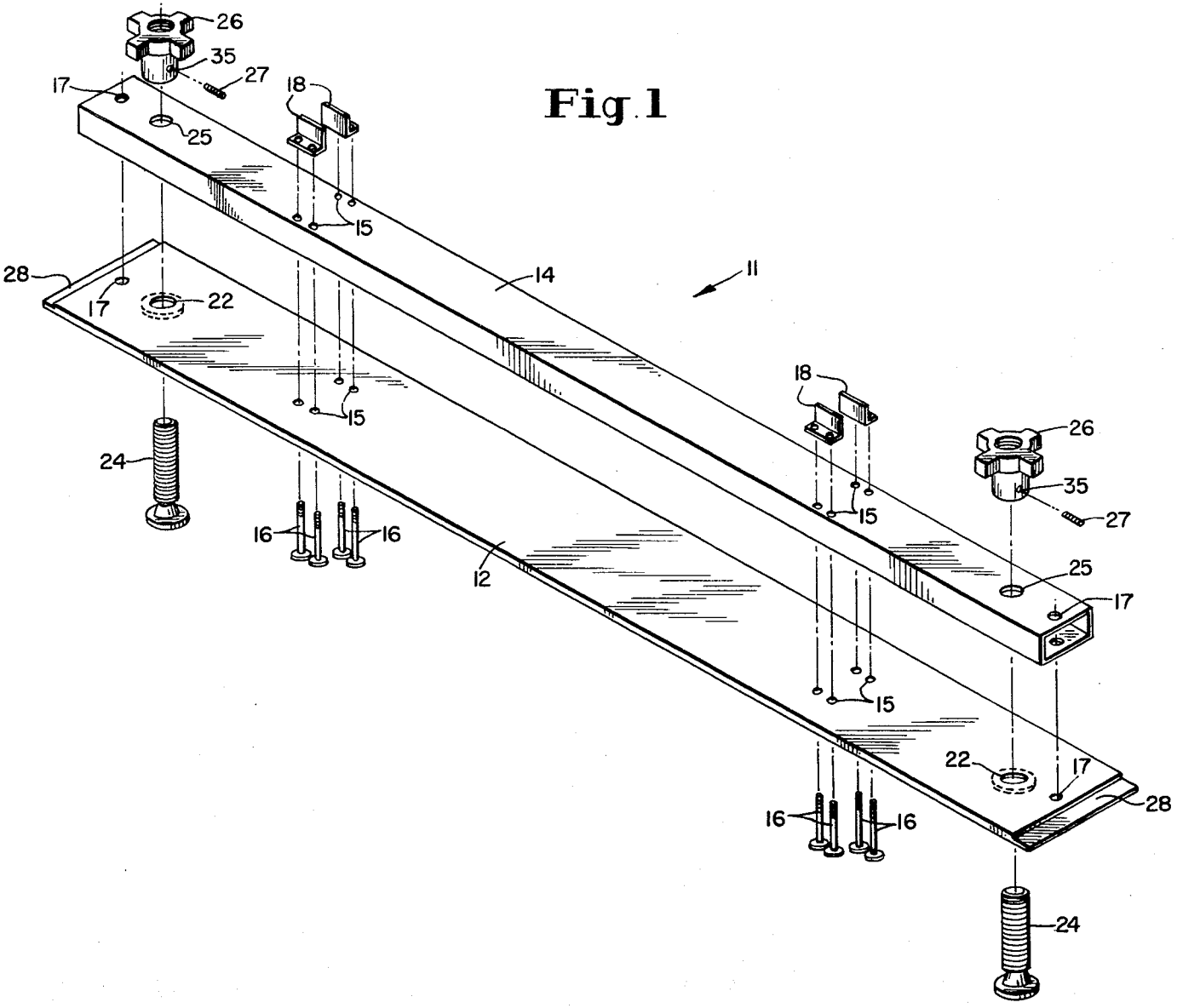
FIG. 1 is a perspective view in exploded form showing the spacer plate assembly with attached components of the leveling device of the present invention.

In the door jamb leveler device 10 of the present invention as shown in FIGS. 1 through 4, there is provided a spacer plate assembly 11 which includes planar member 12 which functions as a central spacer member in conjunction with an upper block member 14 mounted on member 12 and extending along the entire length of the main portion of member 12.

The block member 14 is mounted on the planar member 12 by suitably attachment means such as screws 16 which extend upwardly through holes 15 in planar member 12 and block 14. Additional attachment means may extend through holes 17. The upper ends of screws 16 are threadedly received in L-shaped bracket members 18 which are mounted on the upper surface of the block member 14 for the purpose of receiving a standard carpenter's level 20.

The planar member 12 is provided with a threaded aperture 22 at each end thereof for the purpose of receiving a bolt shaped, threaded swivel member 24 which extends upwardly through respective apertures 22, 25 in members 12 and 14. A hand screw 26 in the form of a knob shaped member of conventional construction is threadedly received on the upper end of each of the swivel members 24. A set screw 27 or similar means is inserted in hole 35 in the side of each hand screw 26 to maintain the hand screw 26 in a fixed position on the respective swivel member 24. In one embodiment, the swivel member 24 is formed with a swivel construction directly below the threaded portion of member 24, thus allowing the threaded portion to pivot about the base of member 24. One form of such a swivel member is known as a knob shoe.

The planar member 12 is provided with a lip extension 28 of relatively thin vertical dimension on each end of member 12. The lip extensions 28 extend beneath the inner portions 29 of the sides of the jamb 31 during the leveling procedure.

Figures 2, 3, 4:
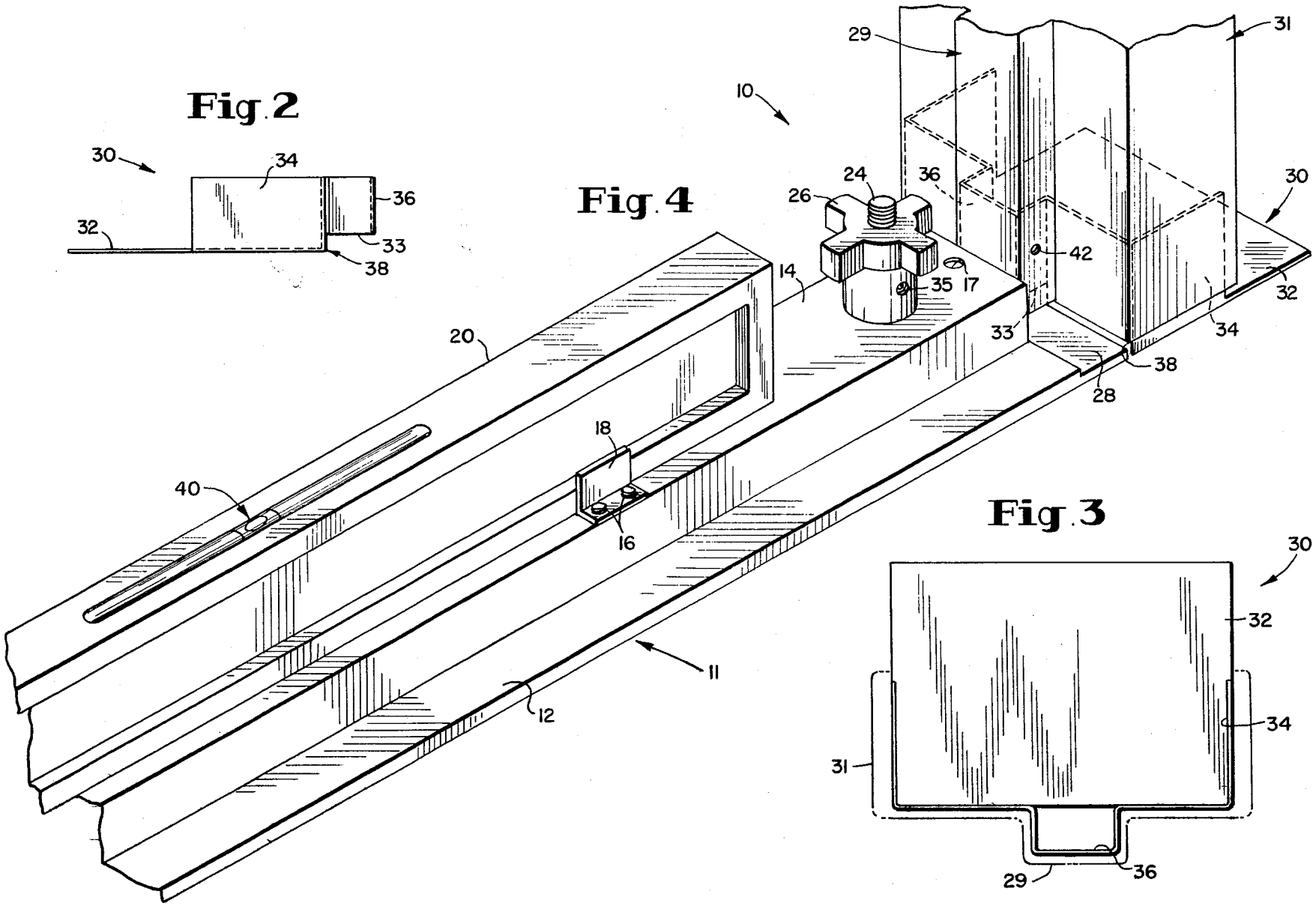
FIG. 2 is a side elevational view of a jamb anchor plate member of the present invention.
FIG. 3 is a plan view of a jamb anchor plate member of the present invention.
FIG. 4 is a perspective view showing the spacer plate assembly of the present invention in cooperation with a jamb anchor plate member for the level of a door jamb, and with a standard carpenter's level mounted on the upper surface of the spacer plate assembly.

The door jamb leveler device 10 of the present invention further includes a pair of anchor base plate members 30, with each anchor plate member 30 having a horizontal planar portion 32 and an upstanding vertical portion 34 in sheet form which extends upwardly from planar portion 32 and conforms to the configuration of the interior of the hollow vertical side portion of the door jamb 31. The central portion 36 of each upstanding member 34, conforming to the inner portion 29 of the side wall of the door jamb 31, has its lower edge 33 sufficiently raised above the planar portion 32 so as to avoid being engaged by the lip extension 28 on member 12 during the leveling operation. The outer end of each lip extension 28 of the planar spacing member 12 is thus contiguous in use with the respective inner end 38 of the horizontal planar portion 32 of the base plate members 30, as shown in FIG. 4.

In order to level the door jamb 31, the spacer plate assembly 11 is positioned on the floor so as to extend across the width of the proposed doorway. The base plates 30 are then positioned on the floor so as to contiguous with the lip extensions 28 of the spacer member 12 as previously described. The outer edge of each lip extension will be aligned along the length of the inner end portion 38 of the base plate 30, thus aiding in proper alignment of the base plate 30 and the door jamb 31. The base plates 30 are anchored to the floor by the use of, for example, a conventional anchoring gun with suitable rivets or similar means. The door jamb 31 is then positioned so that the side wall portions will coincide with previously formed vertical members 34 of the base plates 30 and with inner portions 29 of the jamb 31 resting on the lip extensions 28 of the spacer member 12. The hand screws 26 at each end of spacer plate assembly 11 are then manually turned, causing the spacer member 12 to move up or down along the length of the threaded swivel members 24. Turning of the hand screws 26 continues until the sight glass 40 in the carpenter's level 20 shows the jamb 31 to be in a level condition. Anchor screws 42 are then driven through the jamb 31 into the jamb anchor base plates 30 at either end to retain the jamb 31 at the desired height. The spacer plate assembly 11 may then be removed from the doorway by sliding the lip extensions 28 out from under jamb inner portions 29 and the jamb 31 will be retained in a level position by the anchor plates 30 which are permanently affixed to the door jamb 31 and to the floor.

The specific dimensions to be employed for the door jamb leveling device 10 of the present invention will depend upon the size of the door jamb 31 to be installed. In general, the length of the planar spacer member 12 should be sufficient to extend from one side wall portion of the door jamb 31 to the other, and with the lip extensions 28 on either end of the member 12 extending under center portions 29 of the jamb 31 to engage the inner surfaces 38 of the base portion 32 of anchor plates 30 along the entire length of surfaces 38. Thus the overall length of the spacer member 12, including lip extensions 28, may be of a size such as 2' 4", 2' 8", 3' or 4', for example, all of which are standard door jamb sizes. In one embodiment of the invention, in which the overall length of spacer member 12 is 3 feet, the width of member 12 is 4 inches, the vertical dimension of the lip extension 28 is $\frac{1}{8}$ inch and the length of extension 28 is $\frac{5}{8}$ inch. In this embodiment, the base portion 32 of jamb anchor plate 30 has an overall length of $3\frac{3}{8}$ inches and inner portion 36 thereof has a length of $\frac{5}{8}$ inches. The height of anchor plate 30 is 2 inches and the lower edge of portion 36 is located about $\frac{1}{2}$ inch above the base 32. The anchor plates 30 may be constructed of prefabricated steel or similar material. The spacer plate members 12 and 14 may be constructed of a suitable metal or other durable material.

The invention may be embodied in other specific forms without departing from the spirit or essential characteristics thereof. The present embodiments are therefore to be considered in all respects as illustrative and not restrictive, the scope of the invention being indicated by the appended claims, rather than by the foregoing description and all changes which come within the meaning and range of equivalency of the claims are therefore intended to be embraced therein.

What is claimed and desired to be secured by Letters Patent is:

1. A device for leveling a door jamb, comprising:

a planar central spacer member having a threaded aperture at each end and a lip portion of relatively thin vertical dimension located at each outer end of said spacer member; a bolt member threadedly received in each of said apertures, each bolt having knob means at the upper end for use in rotating said bolt; means attached to said spacer member for indicating the level condition of said spacer member; and a pair of anchor base plates located adjacent to and aligned with the lip portion of the respective ends of said spacer member, each base plate having a planar base member and a vertical member extending upwardly therefrom, said vertical member having a shape which conforms to the interior configuration of a side portion of the door jamb, and wherein said vertical member of each base plate has a central portion which extends over the lip portion on the respective end of said spacer member, the lower edge of said central portion being raised above the respective lip portion.

2. The device of claim 1 wherein said bolt members are formed with a swivel construction which allows each bolt member to pivot about the base thereof.

3. A method of leveling a door jamb having a top wall member joined by two side wall members, which comprises:

(a) positioning a planar central spacer member on the surface of a floor so as to extend across the width of the proposed doorway, said spacer member having a threaded aperture at each end and a lip portion of relatively thin vertical dimension located at each outer end of said spacer member, and with a bolt member being threadedly received in each of said apertures, each bolt having a knob portion at the upper end for use in rotation of said bolt, and wherein said spacer member has attached thereto a level indicating unit;

(b) mounting a jamb anchor base plate in the floor in contiguous relation with the lip portion at each end of said spacer member, each base plate having a planar base member and a vertical member having a shape which conforms to the interior configuration of a side wall of the door jamb;

(c) mounting the door jamb so that the side wall portions extend over and adjacent to the corresponding vertical members of said base plates, and with the center portions of said side walls resting on the lip portions of the spacer member;

(d) rotating the bolt members of said spacer member until the level indicating unit shows the spacer member to be in a level condition;

(e) securing each door jamb side wall to the respective anchor base plate while said spacer member is in a level condition; and (f) removing the spacer member from the doorway.

4. The method of claim 4 wherein the vertical member of each base plate has a central portion which extends over the lip portion on the respective end of said spacer member, the lower edge of said central portion being raised above the respective lip portion.

* * * * *